US006131204A

United States Patent [19]

Otey

[11] Patent Number: 6,131,204

[45] Date of Patent: Oct. 17, 2000

[54] EAR AND NECK PROTECTION ENSEMBLE

[75] Inventor: Pauline S. Otey, P.O. Box 511, St. Charles, Mo. 63302

[73] Assignee: Pauline S. Otey, St. Charles, Mo.

[21] Appl. No.: 09/235,089

[22] Filed: Jan. 21, 1999

[51] Int. Cl.[7] ..... A42B 1/06

[52] U.S. Cl. ..... 2/209; 2/172

[58] Field of Search ..... 2/174, 172, 207, 2/209

[56] References Cited

U.S. PATENT DOCUMENTS

| | | | |
|---|---|---|---|
| 2,124,431 | 7/1938 | Praytor | 2/174 |
| 3,235,882 | 2/1966 | Coleman | 2/174 |
| 5,628,070 | 5/1997 | Kefelian | 2/174 |
| 5,675,840 | 10/1997 | Clavelle | 2/174 |

*Primary Examiner*—Bibhu Mohanty

[57] ABSTRACT

Flexible individual ear coverings (2) with an elastic opening (1), and a flexible neck covering (2) with a fabric grip closure (3).

1 Claim, 3 Drawing Sheets

EAR AND NECK PROTECTION ENSEMBLE

BACKGROUND

1. Field of Invention

This invention relates to ear and neck coverings, specifically to protect from heat during hair dryer use.

2. Description of Prior Art

Beauty salon clients have continually submitted to hairdressing processes in which the hair dryer is being used.

Complaints are of excessive heat to the ears and neck.

U.S. Pat. No. 4,133,052 issued to Hodgman (1979) shows an arrangement for salon patrons, to protect from heat, but the use of this equipment would be very time consuming.

U.S. Pat. No. 5,675,840 issued to Clavelle (1997) appear to be very expensive to use.

U.S. Pat. No. 5,718,001 issued to Wright (1998) seem to be uncomfortable for use.

U.S. Pat. No. 5,023,954 issued to Lyons (1991) is confining by holding the ears against the head.

None of the prior arts have been known in use.

OBJECTS AND ADVANTAGES

Several objects and advantages of the present invention are:

(a) to provide protection from excessive heat exposure to the ears.

(b) to provide protection from excess heat exposure to the neck.

(c) to provide simplicity and convenience of use.

(d) to provide comfort.

DRAWINGS FIGURES

Figure 1:
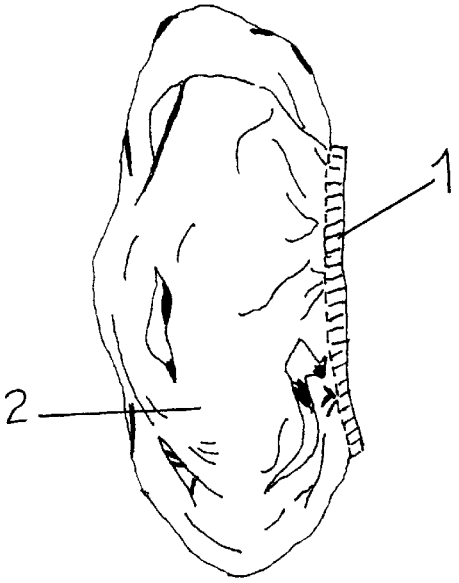
FIGS. 1 and 2 show different views of ear protectors with an elastic band opening.

REFERENCE NUMERALS IN DRAWINGS 1 elastic band 2 protective material 3 fabric grip closure

DESCRIPTION-FIGS. 1 TO 6

Figure 2:
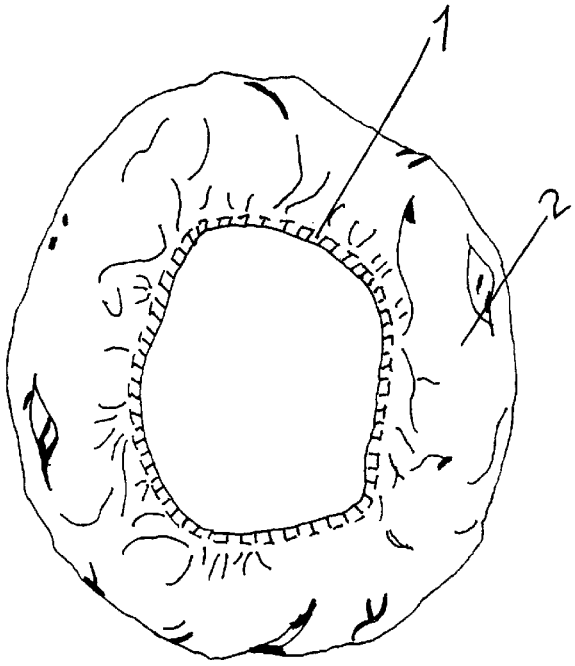
Figure 3:
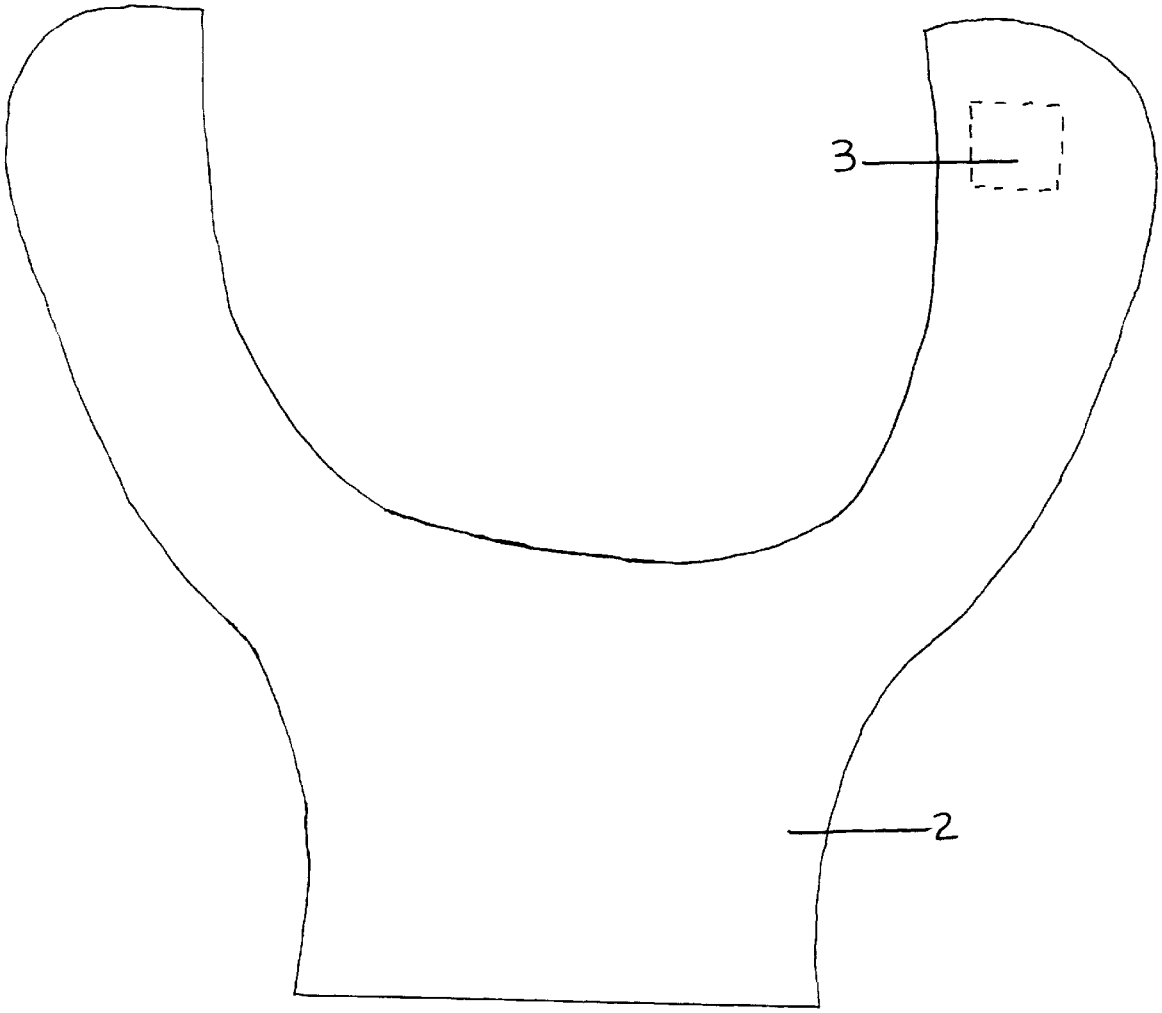
FIG. 3 shows a neck protector with a fabric grip closure on one side.

The embodiment of the ear and neck protective coverings in the present invention is illustrated in FIGS. 1, 2, and 3.

The ear protector consists of a flexible material 2 which an elastic band 1 has been attached to form a cup-like shape.

The neck protector consists of a flexible material 2 to which a fabric grip closure 3 has been attached to one end for closing.

The material used in this embodiment is polyester, but can consist of any other heat resistant material.

OPERATION

Figure 4:
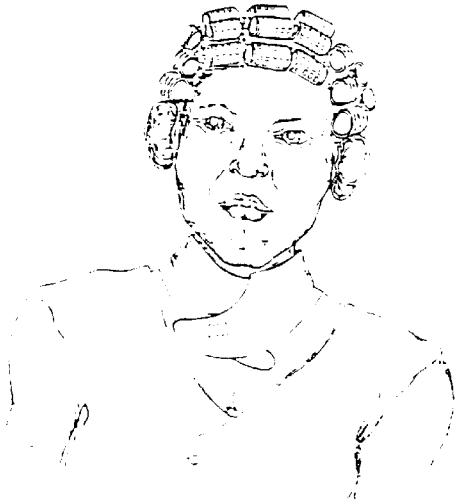
FIG. 4 shows front view of the ear and neck protectors worn prior to getting under the hair dryer.
Figure 5:
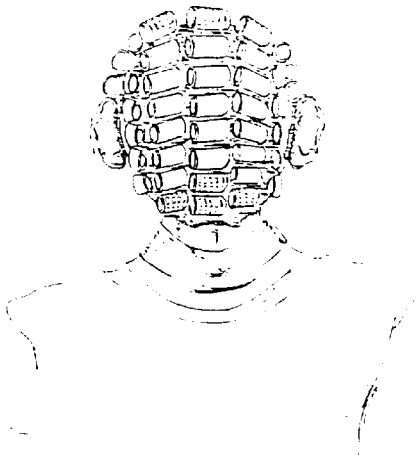
FIG. 5 shows back view of ear and neck protectors worn prior to getting under the hair dryer.
Figure 6:
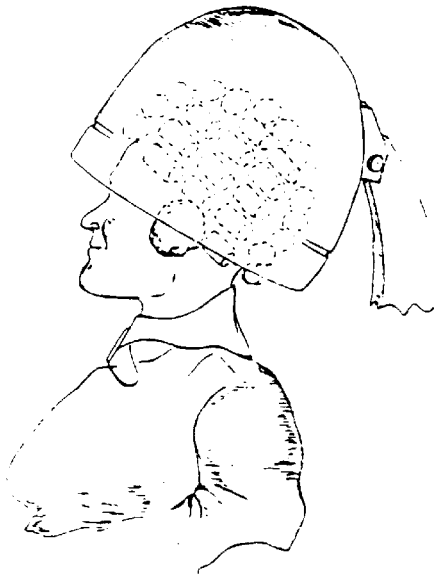
FIG. 6 shows the side view of the ear and neck protectors worn while under the hair dryer.

The manner of using the ear and neck protection ensemble is to slip the ear protectors over the ears using the hands, thereby fully covering each ear (FIG. 4).

Position the neck protector on the back below the neck and bring the ends around the neck, one on each side, with the ends overlapping, and gently press together to secure ends (FIG. 4).

Open the closure to readjust or after use by pulling one of the ends out and away from the other.

SUMMARY, RAMIFICATIONS, AND SCOPE

The ear and neck protection ensemble protects the ears and neck from excessive heat and has additional advantages in that the color may be easily changed;

the size may be easily changed.

This invention can have other shapes, may be made as a single item, or made with other materials to be more durable.

I claim:

1. An ear and neck protection ensemble comprising:

a pair of ear protectors each comprising of a circular piece of flexible material having a peripheral edge with elastic attached along the edge whereby each ear protector may conformingly fit over a wearer's ear; and a neck protector comprising a piece of flexible material having a substantially square shaped lower portion and a curved upper portion whereby the neck protector is adapted to cover the back of a wearer's neck and extend downwardly therefrom, the neck protector further comprising a pair of straps wherein each strap extends upwardly and outwardly from a side of the curved upper portion such that the upper portion and the straps together form a U shape and wherein one of said straps includes a fastener at a distal end thereof which can be used to secure said distal end of said one of said straps to a distal end of the other of said straps whereby the straps may be wrapped about a wearer's neck and fastened together at an upper chest portion of the wearer.

* * * * *